US005092630A

United States Patent [19]

Ostrowski

[11] Patent Number: 5,092,630

[45] Date of Patent: Mar. 3, 1992

[54] ADJUSTABLE PROTECTIVE BOOK COVER AND METHOD

[76] Inventor: Michael J. Ostrowski, 91 Old Toll Rd., West Barnstable, Mass. 02668

[21] Appl. No.: 654,070

[22] Filed: Feb. 11, 1991

[51] Int. Cl.[5] ..... B42D 3/00; B42D 3/02; B42D 3/04

[52] U.S. Cl. ..... 281/34; 281/29; 281/35

[58] Field of Search ..... 281/29, 31, 34, 35

[56] References Cited

U.S. PATENT DOCUMENTS

| | | | |
|---|---|---|---|
| 2,311,153 | 2/1943 | Carlo | 281/34 |
| 5,013,068 | 5/1991 | Maldonado | 281/31 |

FOREIGN PATENT DOCUMENTS

| | | | |
|---|---|---|---|
| 174766 | 1/1977 | Canada | 281/34 |
| 1091364 | 4/1955 | France | 281/34 |
| 313575 | 6/1956 | Switzerland | 281/34 |
| 683885 | 12/1952 | United Kingdom | 281/34 |
| 808404 | 2/1959 | United Kingdom | 281/34 |
| 106398 | 5/1977 | United Kingdom | 281/34 |

*Primary Examiner*—Paul A. Bell
*Attorney, Agent, or Firm*—Richard P. Crowley

[57] ABSTRACT

A protective book cover which comprises a sheet material with folded over top and bottom edges and side edges with short hems, with a fully stretchable flat band loop of elastic material contained within each hem. The side edges are folded over to the width of the back, forming side pockets for the insertion of a book cover within the side pockets, with the book cover snugly retained by the elastic material about the book.

7 Claims, 1 Drawing Sheet

ADJUSTABLE PROTECTIVE BOOK COVER AND METHOD

BACKGROUND OF THE INVENTION

Book jackets or book covers providing protective covering for books, magazines or other publications are widely employed and may be composed of a variety of sheet materials, including fabric, plastic, paper and combinations thereof.

It is desirable to provide for a simple and effective, protective book cover which is not bulky, and which is easily adjusted so that it may snugly fit the book, the cover of which is to be protected. Further, it is desirable to provide for an adjustable book cover, inexpensive to manufacture and which is easy to install and easily assembled or disassembled from the book on which it is employed.

SUMMARY OF THE INVENTION

The invention relates to an adjustable book cover and a method of securing the book cover to a book. In particular, the invention concerns an adjustable book cover and method wherein a closed loop of elastic material is enclosed within side hems and employed to a permit snug adjustment of the book cover to fit the book which is to be covered.

The invention concerns a protective book cover which comprises a generally rectangular, foldable, protective book cover sheet material which, for example, may be composed of fabric, plastic, paper or a combination thereof and, more typically, is a nylon or denim sheet material or a combination of a PVC sheet material with a nylon backing. The book cover sheet material has a top and bottom edge and side edges with the top and bottom edges folded over a defined distance inwardly, so that the folded sheet material has a length of about or generally slightly less than than the length of the book cover to be protected. Both side edges of the cover sheet materials have a short width hem extending along the full length of the side edges. The protective book cover includes a flat, closed loop of elastic-type material such as a flat, elasticized, fabric-type material, for example, of ¼-1 inch in width slidably positioned within each of the side hems and having an exposed, material section extending from the top and bottom edges of the hem. The elastic-type material is selected to provide for full, elasticized movement between a non-protective, relaxed, unused position and a snug, stretched, book-protective position wherein the book cover is inserted between the exposed, elastic-type material and the folded over side edges of the book cover material which forms side pockets for the book cover. The flat, enclosed loop of elastic-type material is generally unsecured, or secured only at a single point, within the hem so that it may be fully stretched in assembling and disassembling the book cover; for example, from an unused to a used position of from 2 to 6 inches, or more particularly, for example, from unused 7 inch to 11 inch length of a typical book cover. Elastic material which is secured at two or more positions within the hem considerably reduces the ability of the material to stretch to cover books of different lengths.

The protective book cover thus provides for an easily manufactured, simple, yet effective, protective book cover which may be easily fit or assembled onto a book cover to serve as a protective book cover. The full stretching of the unsecured loop of elastic-type material within the side hems of the book cover permits the rapid assembling and disassembling and folding for storage of the unused protective book cover.

The invention also concerns a method of covering a book or other publication having, typically, a hard cover, and which method comprises: folding over the top and bottom edges of a book cover sheet material a generally defined book length distance; hemming the side edges of the book cover material along the full side edges of the book cover material; encasing within the side hemmed edges an enclosed loop of an elastic-type material within the hemmed side edges and elastic material extending between the top and bottom edges of the book cover material; folding over the side edges containing the elastic-type material, a defined side distance equal to the width of the book to be covered to form a receptive book cover side pocket and inserting the book covers within the exposed loops of the elastic-type material. The elastic-type material is designed so as to fully stretch to provide for a snug, protective fit of the book cover material about the exterior of the book.

The invention will be described for the purposes of illustration only in connection with certain embodiments; however it is recognized that various modifications, changes, additions and improvements of the illustrated embodiments may be made by those persons skilled in the art, all falling within the spirit and scope of the invention.

DESCRIPTION OF THE EMBODIMENTS

Figure 1:
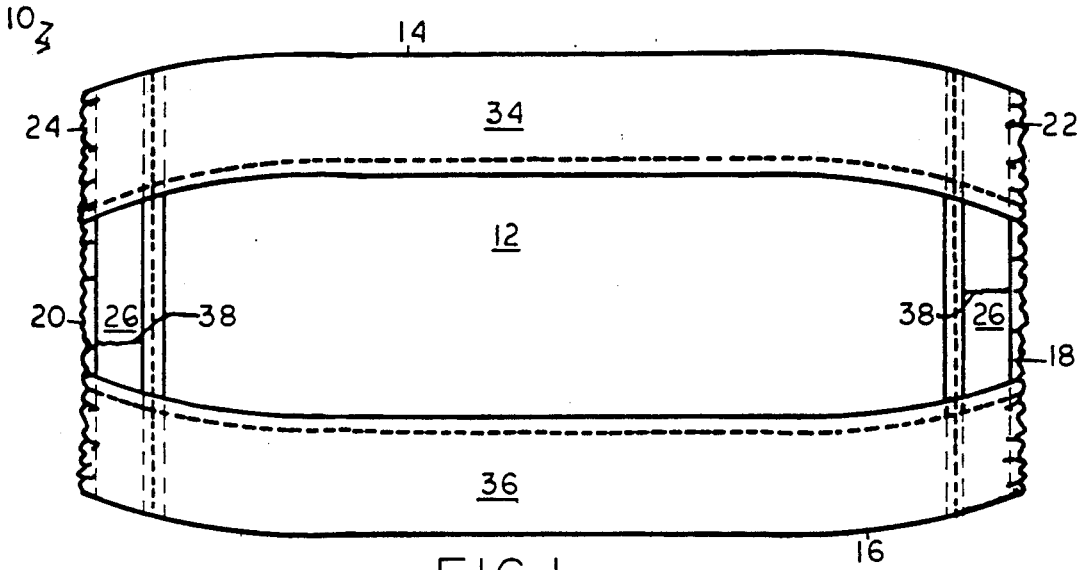
FIG. 1 is a top plan view of a protective book cover of the invention.

With reference to the drawing there is shown a protective book cover 10 composed of a flat, sheet fabric-type material such as nylon 12 having a top edge 14 and a bottom edge 16 with the top and bottom edges of the sheet material 12 which are folded over a defined distance, generally approximating, or slightly less than, the length of the book cover to be protected, to form a folded top section 34 and bottom section 36. The sheet material 12 has side edges 18 and 20 with enclosed, secured, side hems 22 and 24 extending the full length of the side edges. Within the hem section is a flat-type, stretchable, elastic-type material 26 such as an elasticized fabric material like lycra, shown in the relaxed, unstretched condition and adapted to stretch from about 1 to 4 inches, which forms an enclosed loop with the flat, elasticized-type strip material shown joined, such as by sewing the end 38 and movable within the hems 22 and 24. The elastic-type material 26 is exposed and extends from the top 34 and bottom 36 folded over sections and is unsecured in its position within the side hemmed sections 22 and 24. The dotted lines in FIG. 1 and FIG. 2 represent sewn thread lines which share a top and bottom and the side hems 22 and 24.

It has been found that securing at more than one point of the flat loop elastic material tends to restrict the elastic ability of the elastic material 26 to stretch fully to permit a snug fitting of the protective book cover 10 about the book. Thus, the flat-type, elastic-type material can merely be joined at the ends to form a loop and left unsecured, or secured at only one position within the hem 22 and 24. The side hem sections 28 and 30 are merely of sufficient width, for example ½ to 1¼ inches, to contain the elastic-type material 26 and permit the retention and optional, slidable movement and stretchability of the elastic material 26 within the side hems 22 and 24.

Figure 2:
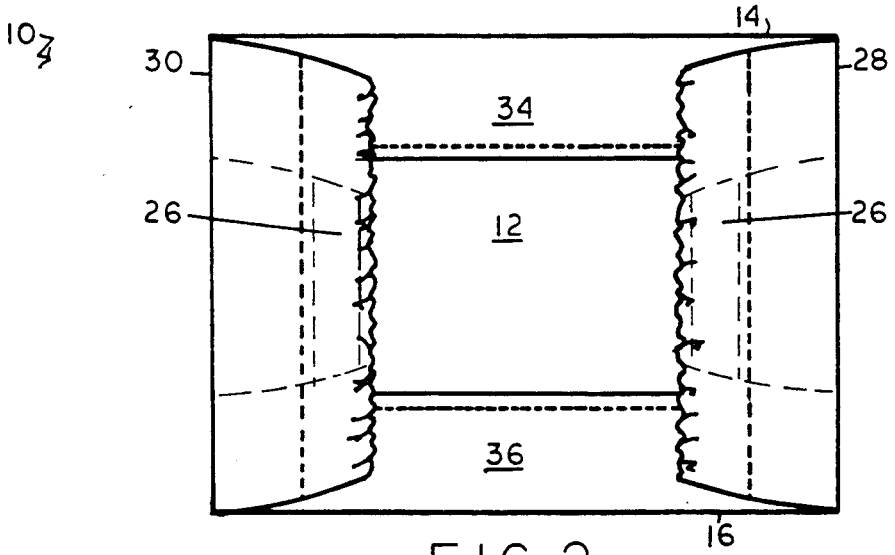
FIG. 2 is a top plan view of the book cover of the invention of FIG. 1 with the side edges folded over.
Figure 3:
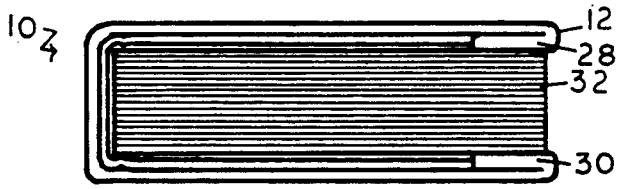
FIG. 3 is an illustrative, sectional end view of the protective book cover of FIG. 1 about a book.

FIG. 1 shows the book cover 10 in the fully extended position. FIG. 2 shows the cover material 10 prepared for use with the edges 18 and 20, with hem 22 and 24 folded over a defined width to form side pockets 28 and 30 to fit the width of the book to be covered. FIG. 3 shows the protective book cover 10 as installed on a book 32 showing that the cover 38 of the book is slipped between the exposed elasticized-type material 26 and the folded over side edges 28 and 30 to form a snug, elasticized, protective book cover about the book 32 by the stretching of the elastic material 26 within hems 22 and 24. The book cover is not bulky, is easily removed and folded for storage, and easily placed on the book.

What is claimed is:

1. A protective book cover which comprises:

a) a generally rectangular, foldable, protective book cover sheet material having a top and bottom edge and side edges, the top and bottom edges folded over a defined distance so that the sheet material has a length of about the length of the book cover to be protected, and the side edges each having a short hem; and b) a flat loop of elastic-type material enclosed within each of the hems and having an exposed section extending from the top and bottom edges of this hem, whereby on folding over of the side folded edges inwardly, to about the width of the book, to form side pockets, the book's cover may be inserted between the exposed section of elastic-type material and the folded over side edges of the sheet material, snugly retaining the book's cover in a protective position about the book.

2. The book cover of claim 1, wherein the elastic-type material comprises a flat band of about ¼ to 1¼ inches of an elasticized fabric material.

3. The book cover of claim 1, wherein the elastic material is unsecured, or secured only at a single position, within the hem.

4. The book cover of claim 1 where the elastic material expands from between about 7 to 11 inches.

5. The book cover of claim 1 wherein the elastic material is secured at its ends to form a loop and is unsecured and adapted for slidable movement within the side hems.

6. A book having covers covered with the protective book cover of claim 1.

7. A method of protecting a book having hard covers, which method comprises:

a) providing the protective book cover of claim 1;

b) folding over the side edges of the book cover to a width of about the width of the book to be covered to form side pockets;

c) inserting the cover of the book into the side pockets by stretching the loop of elastic material within the hems sufficiently to insert the book cover; and d) permitting the elastic material to snugly fit the sheet material about the cover of the book to provide a simple, effective, snugly fit, slim, protective, book cover about the book.

* * * * *